United States Patent [19]

Tokunaga et al.

[11] 4,172,717

[45] Oct. 30, 1979

[54] PERMANENT MAGNET ALLOY

[75] Inventors: Masaaki Tokunaga; Chitoshi Hagi; Hirokazu Murayama, all of Kumagaya, Japan

[73] Assignee: Hitachi Metals, Ltd., Japan

[21] Appl. No.: 893,528

[22] Filed: Apr. 4, 1978

[51] Int. Cl.[2] ..... H01F 1/04; H01F 1/14; H01F 7/02

[52] U.S. Cl. ..... 75/152; 148/31.57

[58] Field of Search ..... 75/152; 148/31.57

[56] References Cited

U.S. PATENT DOCUMENTS

| | | | |
|---|---|---|---|
| 3,947,295 | 3/1976 | Tawara et al. | 148/31.57 |
| 3,997,371 | 12/1976 | Tokunga et al. | 148/31.57 |
| 4,081,297 | 3/1978 | Nagel et al. | 148/103 |
| 4,082,582 | 4/1978 | Menth et al. | 148/102 |

OTHER PUBLICATIONS

Tawara et al., "Rare Earth-Cobalt —Composition," IEEE Trans. Magnetics, *Mag*-12, (Nov. 1976), 954.

*Primary Examiner*—L. Dewayne Rutledge
*Assistant Examiner*—Upendra Roy
*Attorney, Agent, or Firm*—Craig and Antonelli

[57] ABSTRACT

A permanent magnet alloy consisting of the composition expressed by a formula $$-R(CO_{1-x-y-z}Fe_xCu_yHf_z)_A$$

where R = Sm, Ce or a rare earth element or a combination thereof, $0.01 \leqq x \leqq 0.40$ $0.02 \leqq y \leqq 0.25$ $0.001 \leqq z \leqq 0.15$, and $6.5 \leqq A \leqq 8.3$.

5 Claims, 1 Drawing Figure

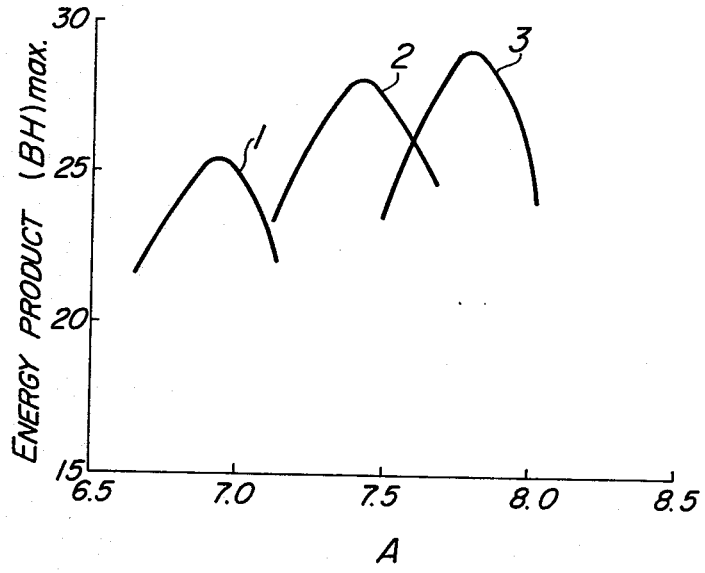
30
25
20
15
ENERGY PRODUCT (BH)max.
1
2
3
6.5
7.0
7.5
8.0
8.5
A

PERMANENT MAGNET ALLOY

BACKGROUND OF THE INVENTION

The present invention relates to generally an improvement in a permanent magnet alloy of an inter-metallic compound consisting of one or more rare earth elements and Co and more particularly to an improvement of a permanent magnet alloy of a Cu-added $R_2Co_{17}$ type with a lower content of a rare earth element.

As is disclosed in for example Japanese unexamined Patent Publication No. 1397/75, it has been well known in the art that an alloy consisting of Co, Fe, Cu and rare earth metal or metals in combination mainly consisting of Sm and Ce the composition of which is expressed by a formula $$R(Co_{1-x-y}Fe_xCu_y)_A$$

where R=a rare earth metal or a combination of rare earth metals mainly consisting of Sm and Ce, $$0.01 \leqq x \leqq 0.03$$

$$0.05 \leqq y \leqq 0.25, \text{ and}$$

$$6.5 \leqq A \leqq 8.0,$$

exhibits excellent remanance (Br) and coercive forces ($_BH_c$, $_IH_c$). Furthermore it has an energy product ((BH)max) as high as 25 M GOe. Therefore, it has been used in various fields. However in this magnet series, a large amount of Cu substitution is required for attaining desired degree of precipitation hardening. As a result, Br is decreased and a maximum remanance Br is of the order of 10,500 G. Furthermore, the decrease in Curie point due to Cu substitution results in a decrease in thermal stability. Fe substitution contributes to an increase of remanance Br, but an excessive Fe substitution results in a decrease in coercive force. As a consequence a maximum Fe substitution x is in the order of 0.1. Moreover, the value of A required in order to increase coercive force and to obtain a better squareness of a hysteresis curve is in the order of 7.0–7.5, therefore a high remanance Br cannot be obtained.

SUMMARY OF THE INVENTION

Accordingly, the primary object of the present invention is to provide a permanent magnet which may substantially overcome the above and other defects encountered in the prior art permanent magnets and which is very useful in industry.

Briefly stated, the present invention is characterized in that in order to attain the above and other objects the amount of Cu substitution required for a desired degree of precipitation hardening may be decreased by the addition of Hf and the amount of Fe substitution may be increased, whereby a permanent magnet having excellent magnetic characteristics may be obtained.

The inventors conducted extensive studies and experiments and found the fact that the addition of Hf can reduce the amount of Cu required for obtaining a desired degree of precipitation hardening and is also able to avoid a decrease in IHc due to the Fe substitution.

As with the Cu addition, the addition of Hf results in a decrease in both Br and Curie point, but the amount of Cu substitution may be decreased, as a result, both the Br and Curie point may be increased. Thus the addition of Hf is advantageous not only in that the magnetic characteristics of the Cu-added $R_2Co_{17}$ magnet may be improved but also in that the thermal stability may be enhanced.

According to the present invention, when the amount z of Hf is less than 0.001, the decrease in Cu substitution may hardly be attained, and if the amount z is in excess of 0.15, a decrease in both Br and Curie point results so that the magnetic characteristics and the thermal stability are degraded.

In general, the decrease in Fe content results in a decrease in Br while the addition of an excessive amount of Fe results in a decrease in coercive force. However, according to the present invention Hf is added so that the increase in Fe substitution which is effective for increasing Br will result in only a lesser extent of the decrease in coercive force. As a result, the Fe substitution may be increased as compared with an alloy not added with Hf, so that a higher Br value may be obtained. However, when the Cu substitution y is less than 0.02, the addition of Hf will not attain a sufficient coercive force which the so-called precipitation hardened type permanent magnet alloys must have. When the Cu substitution y exceeds 0.25, a decrease in remanance Br results, that is, the features of the present invention cannot be attained. The addition of Hf permits the increase in value of A which is required for obtaining a desired degree of coercive force. More particularly, an optimum value of A is 7–7.5 when no Hf is added but the value of A may be increased to 7.5 to 8.3 when Hf is added. This fact proves that the addition of Hf in accordance with the present invention is very effective in increasing remanance Br. Furthermore, in addition to Hf (which is advantageous in practice when added in the form of a master alloy with other metals), Si, Ti, Zr, V, Nb, Cr, Mo and so on may be added in the form of compound additions in order to attain the objects of the present invention.

BRIEF DESCRIPTION OF THE DRAWING

The FIGURE shows the relations between the energy product ((BH)max) versus A of permanent magnet alloys in accordance with the present invention.

DESCRIPTION OF THE PREFERRED EMBODIMENTS

EXAMPLE 1

The alloy having the composition of $Sm(Co_{0.81}Fe_{0.1}Cu_{0.08}Hf_{0.01})_{7.5}$ was arc melted, crushed in a steel mortar, mixed with toluene and milled in an oscillating mill. The powder was compacted in a die under a pressure of 3 ton/cm$^2$ in a magnetic field of 8K Oe. Thereafter, the compacted material was sintered at 1,200° C. for one hour in a stream of Ar gas. The magnet thus produced exhibited the following magnetic characteristics:

$$Br = 10{,}000 \text{ G},$$

$$_BH_c = 4{,}000 \text{ Oe},$$

$$_IH_c = 4{,}200 \text{ Oe, and}$$

$$(BH)max = 22 \text{ M GOe}.$$

After the magnet was further subjected to aging at 800° C. for two hours, it exhibited the following magnetic characteristics:

Br = 10,000 G, $_BH_c$ = 5,200 Oe, $_iH_c$ = 5,500 Oe, and (BH)max = 24 M GOe.

EXAMPLE 2

The alloy with the composition of $Sm(Co_{0.81}Fe_{0.15}Cu_{0.09}Hf_{0.01})_{7.5}$ was arc melted, crushed and compacted in a manner substantially similar to that described in EXAMPLE 1. After having been oriented in the magnetic field of 15K Oe, the powder was compacted by a hydraulic press under a pressure of 3 ton/cm$^2$. The compacted material thus obtained was sintered at 1,200° C. for one hour in a vacuum. Thereafter, the product was gradually cooled from 850° C. to 400° C. at a rate of 1° C./min. The product exhibited the following magnetic characteristics:

Br = 10,800 G, $_BH_c$ = 5,500 Oe, $_iH_c$ = 5,900 Oe, and (BH)max = 27.9 M GOe.

EXAMPLE 3

The alloys of three series, $Sm(Co_{0.75}Fe_{0.10}Cu_{0.15})_A$, $Sm(Co_{0.72}Fe_{0.17}Cu_{0.10}Hf_{0.01})_A$ and $Sm(Co_{0.765}Fe_{0.15}Cu_{0.07}Hf_{0.015})_A$ were arc melted, crushed, milled, compacted, sintered and gradually cooled in the manner described in EXAMPLE 2.

The relationship between (BH)max and A of the above three series samples is shown in FIG. 1, where the characteristic curves of 1, 2 and 3 are of the series $Sm(Co_{0.75}Fe_{0.10}Cu_{0.15})_A$ $Sm(Co_{0.79}Fe_{0.12}Cu_{0.08}Hf_{0.01})_A$ and $Sm(Co_{0.765}Fe_{0.15}Cu_{0.07}Hf_{0.015})_A$ respectively. From FIG. 1 it is apparent that the higher the content of Hf, the less the required amount of Cu substitution becomes and that the higher the value of A, the higher (BH)max becomes.

What is claimed is:

1. A permanent magnet alloy consisting of the composition expressed by a formula $$R(Co_{1-x-y-z}Fe_xCu_yHf_z)_A$$

where R is one or more of a rare earth element mainly Sm or Ce or a combination thereof, $0.01 \leqq x \leqq 0.40$, $0.02 \leqq y \leqq 0.25$ $0.001 \leqq z \leqq 0.15$, and $6.5 \leqq A \leqq 8.3$.

2. A permanent magnet alloy as set forth in claim 1, wherein R is Sm.

3. A permanent magnet alloy as set forth in claim 1, wherein R is Ce.

4. A permanent magnet alloy as set forth in claim 1, wherein R is a combination of Sm and Ce.

5. A permanent magnet alloy as set forth in claim 1, wherein x is at least equal to 0.1.

* * * * *